US009443647B2

(12) United States Patent
Huang et al.

(10) Patent No.: US 9,443,647 B2
(45) Date of Patent: Sep. 13, 2016

(54) VARIABLE RESISTOR

(71) Applicant: TAIWAN ALPHA ELECTRONIC CO., LTD., Taoyuan County (TW)

(72) Inventors: Tzu-Hsuan Huang, Taoyuan County (TW); Wei-Liang Liu, Taoyuan County (TW); Chien-Chih Ho, Taoyuan County (TW)

(73) Assignee: Taiwan Alpha Electronic Co., Ltd., Taoyuan (TW)

( * ) Notice: Subject to any disclaimer, the term of this patent is extended or adjusted under 35 U.S.C. 154(b) by 64 days.

(21) Appl. No.: 14/675,972

(22) Filed: Apr. 1, 2015

(65) Prior Publication Data

US 2016/0217891 A1 Jul. 28, 2016

(30) Foreign Application Priority Data

Jan. 22, 2015 (TW) ..... 104102108 A

(51) Int. Cl.
*H01C 10/38* (2006.01)

(52) U.S. Cl.
CPC ..... *H01C 10/38* (2013.01)

(58) Field of Classification Search
CPC ..... H01C 10/38
See application file for complete search history.

(56) References Cited

U.S. PATENT DOCUMENTS

| | | | | | |
|---|---|---|---|---|---|
| 3,412,361 | A * | 11/1968 | Lovejoy | H01C 10/44 | 338/176 |
| 3,550,059 | A * | 12/1970 | Van Benthuysen | H01C 10/38 | 338/176 |
| 3,594,678 | A * | 7/1971 | Nomura | H01C 10/44 | 338/183 |
| 3,609,623 | A * | 9/1971 | Zdanys, Jr. | H01C 10/44 | 338/125 |
| 3,693,129 | A * | 9/1972 | Shimizu | H01C 10/44 | 338/183 |
| 6,198,380 | B1 * | 3/2001 | Castellano-Aldave | H01C 10/38 | 338/176 |
| 2016/0125984 | A1 * | 5/2016 | Huang | H01C 10/44 | 338/183 |

* cited by examiner

*Primary Examiner* — James Harvey
(74) *Attorney, Agent, or Firm* — Rosenberg, Klein & Lee

(57) ABSTRACT

A variable resistor includes a shell, an inverted circuit module, and a manipulating device. The shell has a shell position restriction hole and an allocation space linked to the shell position restriction hole. The inverted circuit module is fixed in the allocation space and includes a circuit board and a plurality of connecting ends located on the circuit board. The circuit board has a circuit board position restriction hole and a resistance circuit on a rear surface thereof. The manipulating device is slidably assembled in the allocation space and includes a brush base, at least a metal brush, and a bar. The metal brush is fixed on a front surface of the brush base and elastically presses against the resistance circuit. The bar is connected to the brush base and extended outward through the circuit board position restriction hole and the shell position restriction hole.

8 Claims, 7 Drawing Sheets

VARIABLE RESISTOR

FIELD OF THE INVENTION

The present invention is related to a variable resistor, and more particularly related to a variable resistor featuring a circuit board with an opening formed thereon such that the inverted-positioned brush can contact the resistance circuit on the rear surface of the circuit board.

BACKGROUND OF THE INVENTION

In our daily lives, the electronic devices for adjusting voltage signals, such as the variable resistors, can be seen everywhere. According to the type of operation, the variable resistors can be sorted as rotating-type variable resistors and slide-type variable resistors.

FIG. 1 is an explosive view of a conventional slide-type variable resistor. As shown, the variable resistor PA100 includes a circuit base PA1, a manipulating module PA2 and a shell PA3. The circuit base PA1 includes a circuit board PA11 and a plurality of connecting ends PA12. The manipulating module PA2 includes a brush base PA21, two metal brushes PA22, a sliding bar PA23, an elastic unit PA24, and a washer PA25. The brush base PA21 is movably positioned on the circuit board PA11 along the operation direction L. The two metal brushes PA22 are located on a rear surface of the brush base PA21 for pressing against the resistance circuit on the circuit board PA11. The sliding bar PA23 is located on a front surface of the brush base PA21 and passes through the elastic unit PA24 and the washer PA25 in a serial. The shell PA3 is fixed on the circuit base PA1. The shell PA3 also has a position restriction hole PA31 and a plurality of fixing parts PA32. The sliding bar PA23 extends outward from the position restriction hole PA31. The fixing parts PA32 are utilized to have the shell PA3 fixed on the circuit base PA1.

Please also refer to FIG. 2, which is a cross-section view of the conventional slide-type variable resistor. As shown, because the metal brush PA22 is functioned to press against the resistance circuit PA111 of the circuit board PA11, after using for a while, the generated carbon particles would be accumulated on the two sides of the resistance circuit PA111 by the rubbing movement of the metal brush PA22 on the resistance circuit PA111. In addition, because the resistance circuit PA111 is usually positioned close to the conductive circuit, the accumulated carbon particles may cause short circuit between the resistance circuit PA111 and the conductive circuit and further damage the variable resistor PA100. In addition, the accumulated carbon particles may cause the generation of abnormal output signals as the metal brushes is moving.

In addition, because the position restriction hole PA31 is linked to the environment, there might be foreign matters falling into the position restriction hole PA31 to influence the sliding movement of the brush base PA21 or liquid flowing into the position restriction hole PA31 to cause pollution on the circuit board PA11 and electric failure. For example, the debris dropped on the circuit board PA11 when eating food might be stuck on the brush PA22 to influence the sliding operation during the movement of the brush base PA21, or the liquid poured out on the circuit board PA11 when the drink is knocked over might cause circuit failure. In addition, after the variable resistor being used for a while, environment particles might be accumulated on the circuit board PA11 to cause electronic failure.

BRIEF SUMMARY OF INVENTION

As mentioned above, the conventional variable resistor has the resistance circuit positioned on the front surface (i.e. the top surface) of the circuit board and the output voltage signal is adjusted by changing the position where the brush in contact with the resistance circuit. However, because the rubbing movement of the metal brush on the resistance material of the resistance circuit, such as carbon paste, may cause the generation of particles and further have the particles accumulated on the two sides of the resistance circuit, there might be electrical connection between the resistance circuit and the adjacent conductive circuit to cause short circuit because of the accumulation of carbon particles or abnormal output signals due to the existence of carbon particles. In addition, because the conventional technology has the resistance circuit positioned on the front surface of the circuit board facing the position restriction hole right above the circuit board, it would be easy for the environment particles to get into the internal space of the variable resistor through the position restriction hole and further accumulated on the circuit board to cause electric failure after using for a while. In addition, the sliding movement of the brush base might be hindered by the foreign matter dropped into the position restriction hole, and the circuit might be polluted by the liquid flowing into the position restriction hole.

Accordingly, it is a main object of the present invention to provide a variable resistor, which has the feature of the resistance circuit positioned on the rear surface of the circuit board such that the particles generated by the rubbing movement between the brush and the resistance may fall below the circuit board rather than be accumulated on the circuit board to prevent short circuit between the resistance circuit and the conductive circuit as well as the abnormal output signal due to the carbon particles. In addition, because both the conductive circuit and the resistance circuit are positioned on the rear surface of the circuit board, the operation and the function of the variable resistor would not be affected even with the foreign matters and liquid entering the internal space of the shell through the position restriction hole.

As mentioned, a variable resistor is provided in accordance with an embodiment of the present invention. The variable resistor includes a shell, two side guiding tracks, two end locking parts, an inverted circuit module, a manipulating device, and a base.

The shell has a shell position restriction hole extending along an operation direction and an allocation space formed therein linked to the shell position restriction hole. The two side guiding tracks are extending along the operation direction and symmetrically assembled in the allocation space. The two end locking parts are symmetrically assembled in the allocation space and press against the two side guiding tracks respectively to have the two side guiding tracks and the two end locking parts constrained in the allocation space.

The inverted circuit module comprises a circuit board and a plurality of connecting ends. The circuit board is positioned between the two side guiding tracks and has a circuit board position restriction hole extending along the operation direction. In addition, the circuit board has a resistance circuit on a rear surface thereof. The plurality of connecting ends is located on the circuit board.

The manipulating device comprises a brush base, at least a brush, and a bar. The brush base is slidably positioned between the two side guiding tracks. The brush is fixed on a front surface of the brush base and elastically presses against the resistance circuit. The bar is connected to the brush base and extended outward from the circuit board position restriction hole and the shell position restriction hole.

The base presses against the two side guiding tracks and has a plurality of through holes corresponding to the connecting ends. The connecting ends extend outward from the respective through holes, and the shell is assembled to the base to have the two side guiding tracks and the two end locking parts fixed in the allocation space.

In accordance with an embodiment of the present invention, each of the two side guiding tracks has a locking groove, and two sides of the circuit board are locked in the locking grooves of the two side guiding tracks respectively so as to have the circuit board fixed in the allocation space.

In accordance with an embodiment of the present invention, each of the two side guiding tracks has a guiding groove and the brush base is movably assembled to the guiding grooves of the two side guiding tracks to have the circuit board fixed in the allocation space.

In accordance with an embodiment of the present invention, the base is connected to the two end locking parts integrally.

Another variable resistor is provided in accordance with an embodiment of the present invention. The variable resistor comprises a brush, a inverted circuit module, and a manipulating device. The shell has a shell position restriction hole extending along an operation direction and an allocation space formed therein linked to the shell position restriction hole. The inverted circuit module is fixed in the allocation space, and comprises a circuit board and a plurality of connecting ends. The circuit board has a circuit board position restriction hole extending along the operation direction and has a resistance circuit on a rear surface thereof. The plurality of connecting ends is located on the circuit board. The manipulating device is along the operation direction slidably positioned in the allocation space and comprises a brush base, at least a brush, and a bar. The brush is fixed on a front surface of the brush base and elastically presses against the resistance circuit. The bar is connected to the brush base and extended outward from the circuit board position restriction hole and the shell position restriction hole.

In accordance with an embodiment of the present invention, the variable resistor further comprises two side guiding tracks extending along the operation direction and symmetrically assembled in the allocation space. Each of the two side guiding tracks comprises a locking groove and a guiding groove. Two sides of the circuit board are locked in the locking grooves of the two side guiding tracks respectively so as to have the circuit board fixed in the allocation space. The brush base is along the operation direction movably assembled to the guiding grooves of the two side guiding tracks to have the circuit board fixed in the allocation space. As a preferred embodiment, the variable resistor further comprises two end locking parts, which are symmetrically assembled in the allocation space and press against the two side guiding tracks respectively to have the two side guiding tracks and the two end locking parts constrained in the allocation space. As a preferred embodiment, the variable resistor further comprises a base, which presses against the two side guiding tracks. The shell is assembled to the base to have the two side guiding tracks and the two end locking parts fixed in the allocation space, and the base is integrally connected to the two end locking parts and further has a plurality of through holes corresponding to the connecting ends and the connecting ends extending outward from the through holes respectively.

As mentioned, with the features of the circuit board position restriction hole on the circuit board, the resistance circuit positioned on the rear surface of the circuit board, and the brush positioned on the front surface of the brush base to contact the resistance circuit on the rear surface of the circuit board, the particles generated due to the rubbing movement between the brush and the resistance circuit may fall below the circuit board rather than be accumulated on the circuit board. Thus, the problem of short circuit between the resistance circuit and the conductive circuit due to the existence of particles after the variable resistor being used for a while can be effectively prevented.

The embodiments adopted in the present invention would be further discussed by using the flowing paragraph and the figures for a better understanding.

DETAILED DESCRIPTION OF THE INVENTION

Figure 1:
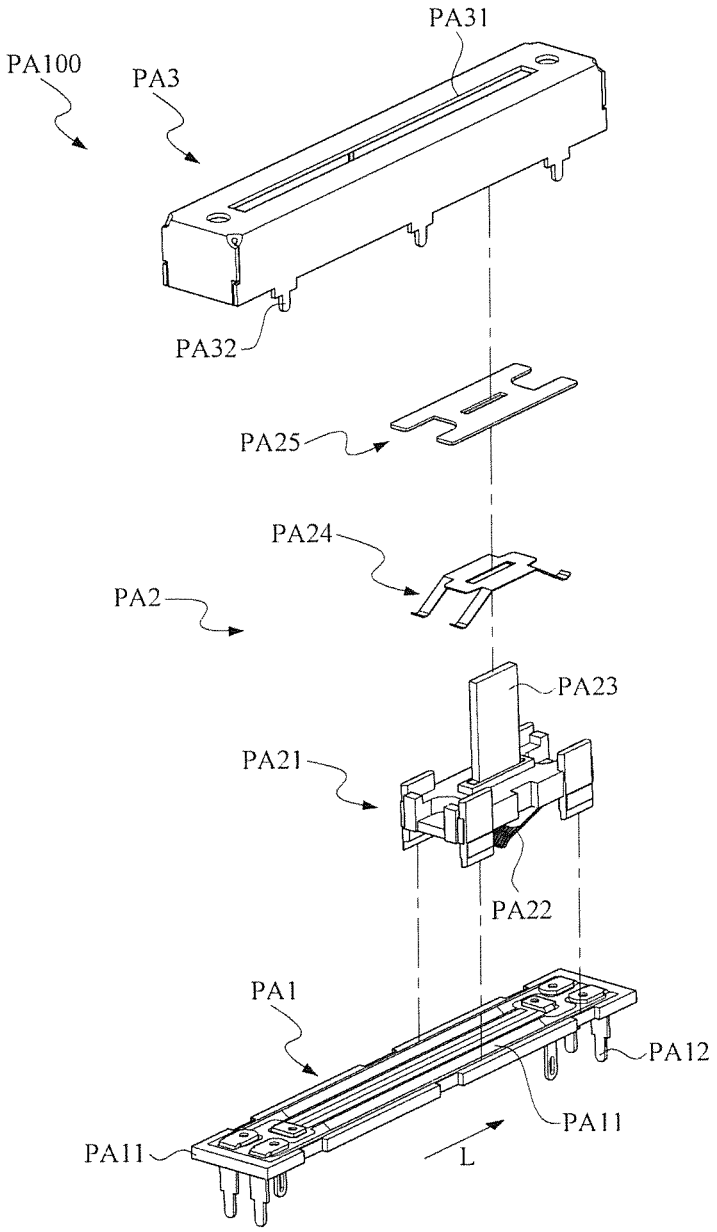
Fig.1(Prior Art)
FIG. 1 is an explosive view of a conventional slide-type variable resistor.
Figure 2:
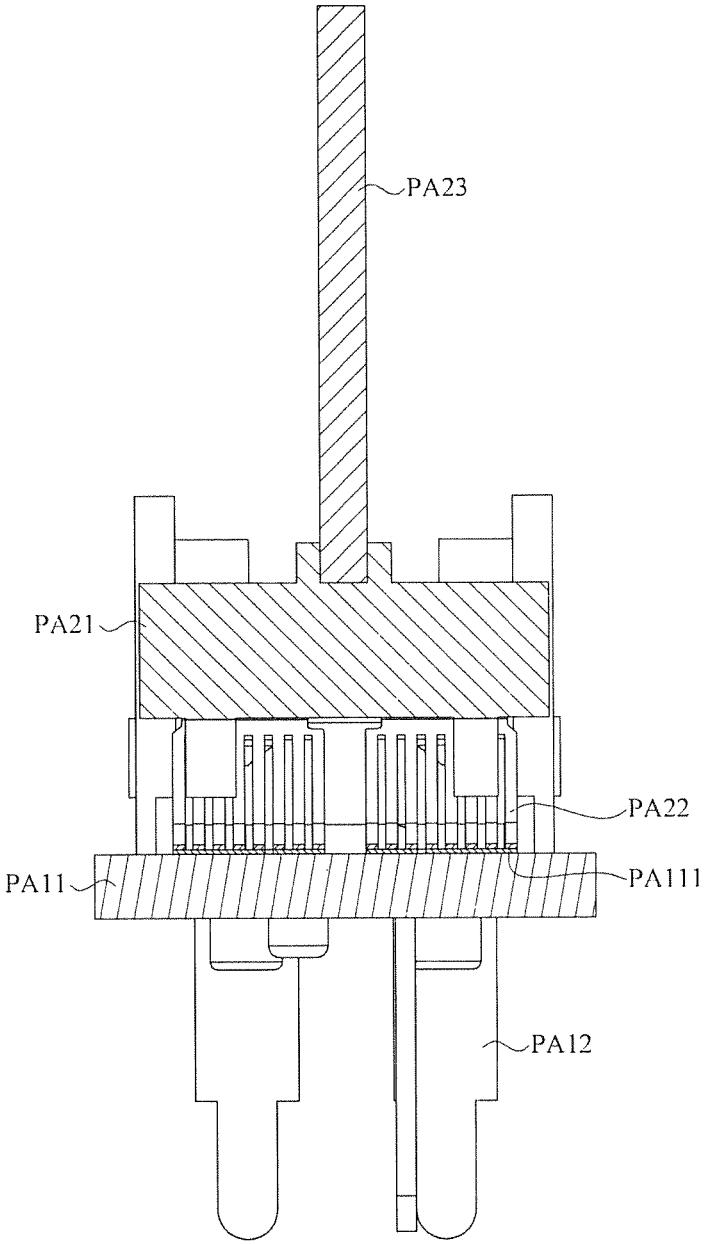
Fig.2(Prior Art)
FIG. 2 is a cross-section view of a conventional slide-type variable resistor.
Figure 3:
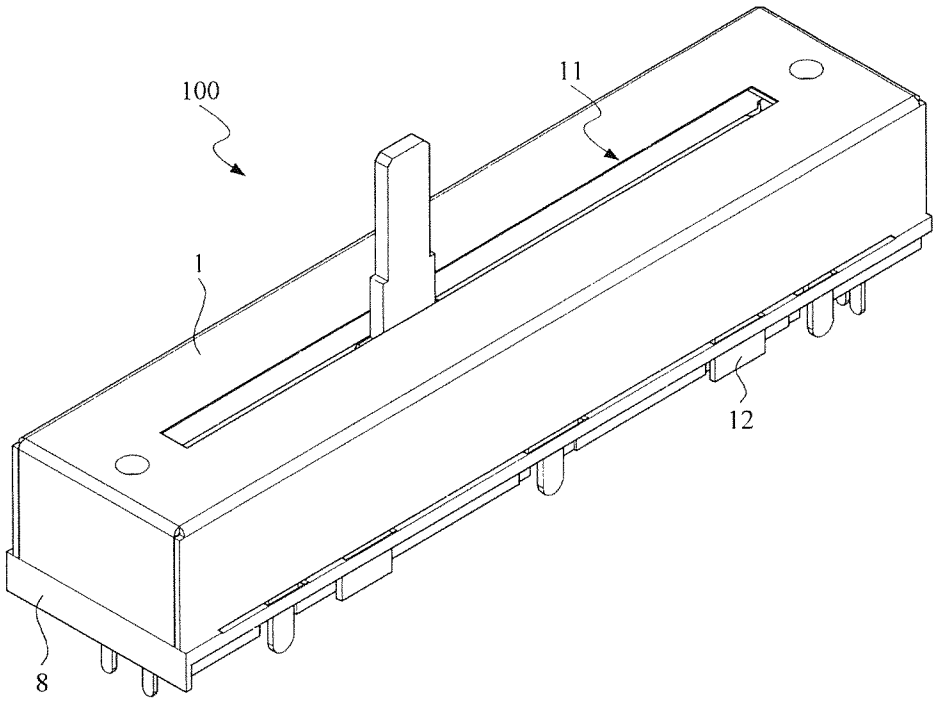
FIG. 3 is a 3D schematic view of a variable resistor in accordance with a preferred embodiment of the present invention.
Figure 4:
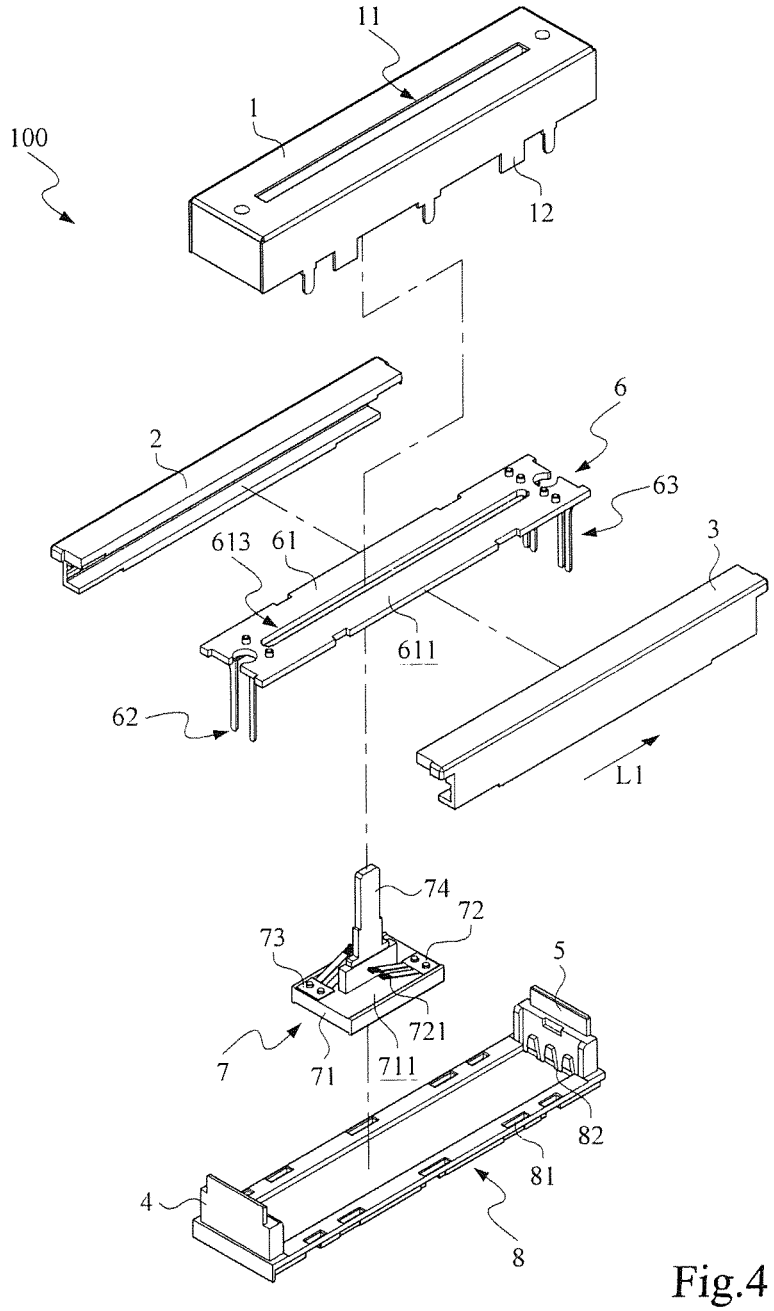
FIG. 4 is a 3D explosive view of the variable resistor in accordance with a preferred embodiment of the present invention.
Figure 5:
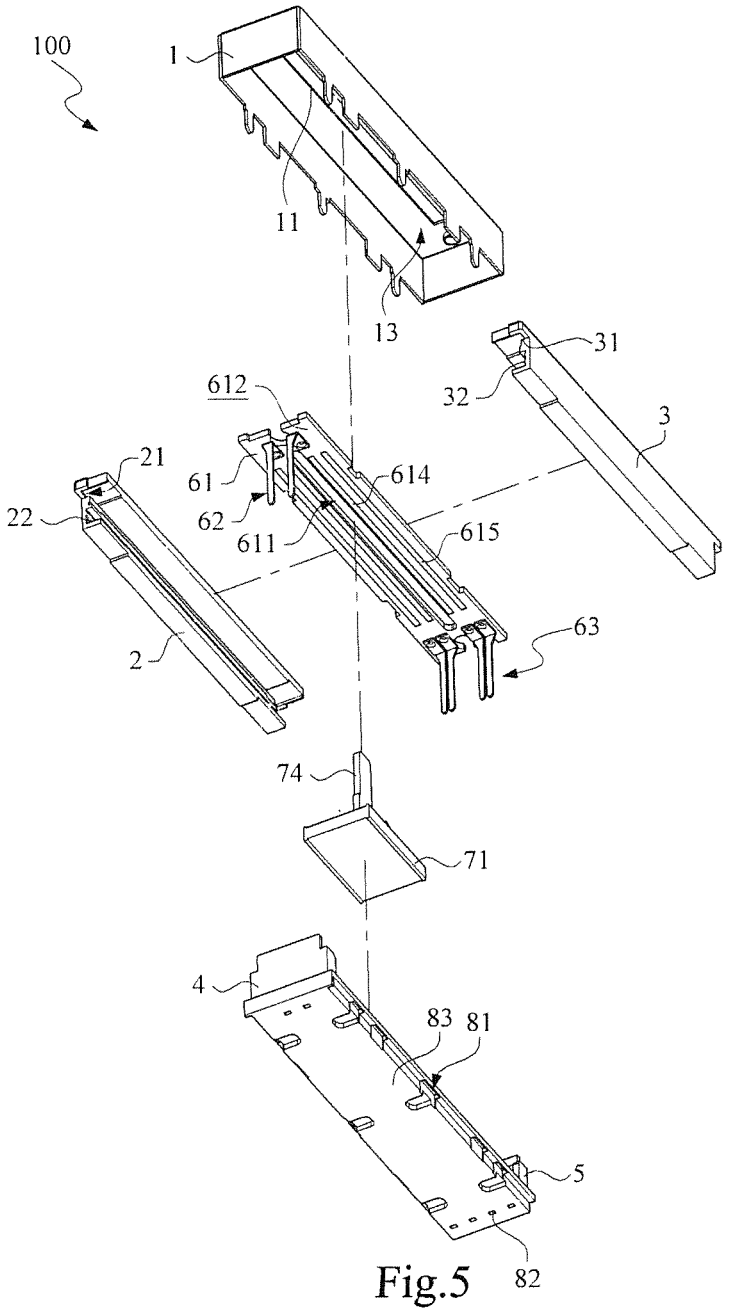
FIG. 5 is another 3D explosive view along a different viewing angle of the variable resistor in accordance with a preferred embodiment of the present invention.

Please refer to FIG. 3 to FIG. 5, wherein FIG. 3 is a 3D schematic view of a variable resistor in accordance with a preferred embodiment of the present invention, FIG. 4 is a 3D explosive view of the variable resistor in accordance with a preferred embodiment of the present invention, and FIG. 5 is another 3D explosive view along a different viewing angle of the variable resistor in accordance with a preferred embodiment of the present invention.

As shown, the variable resistor 100 includes a shell 1, two side guiding tracks 2, 3, two end locking parts 4, 5, an inverted circuit module 6, a manipulating device 7, and a base 8.

The shell 1 has a shell position restriction hole 11 extending along an operation direction L1 and ten extending fixing parts 12 (only one of them is labeled). In addition, the shell 1 also has an allocation space 13 formed therein linked to the shell position restriction hole 11.

The two side guiding tracks 2, 3 are extending along the operation direction L1 and symmetrically positioned in the allocation space 13. The side guiding track 2 has a circuit board fixing groove 21 and a brush base guiding groove 22. Similarly, the side guiding track 3 has a circuit board fixing groove 31 and a brush base guiding groove 32.

The end locking parts 4, 5 are symmetrically positioned in the allocation space 13 and press against the two sides of the two side guiding tracks 2, 3 respectively to have the two side guiding tracks 2, 3 and the two end locking parts 4, 5 constrained in the allocation space 13.

The inverted circuit module 6 includes a circuit board 61 and a plurality of connecting ends (two first connecting ends 61 and four second connecting ends 63 are shown in the present embodiment and only one of them is labeled). As the two side guiding tracks 2, 3 are positioned in the allocation space 13, the circuit board 61 is locked in the circuit board fixing grooves 21, 31 and fixed between the two side guiding tracks 2, 3. The circuit board 61 has a front surface 611 facing the shell position restriction hole 11 of the shell 1 and a rear surface 612 opposite to the front surface 611. The circuit board 61 further has a circuit board position restriction hole 613 extending along the operation direction L1 and also has two conductive circuits 614 (only one of them is labeled) and two resistance circuits 615 (only one of them is labeled) on the rear surface 612 thereof. However, the present invention is not so restricted. In accordance with another embodiment, the number of conductive circuit 614 and resistance circuit 615 can be one. The conductive circuit 614 is a conductive coating layer and the resistance circuit 615 is a resistance coating layer. In practice, the conductive coating layer can be the metal plating layer such as silver or copper, and the resistance coating layer can be a coating layer of resistance material such as carbon.

The two first connecting ends 62 penetrating the circuit board 61 are fixed to an end of the circuit board 61, and the two first connecting ends 62 are electrically connected to a conductive circuit 614 and a resistance circuit 615 respectively. That is, each of the two first connecting ends 62 is electrically connected to a corresponded conductive circuit 614 and a corresponded resistance circuit 615.

The four second connecting ends 63 penetrating the circuit board 61 are fixed to another end of the circuit board 61, which is opposite to the end with the first connecting ends 62, and are electrically connected to the two conductive circuits 614 and the two resistance circuits 615 respectively. That is, the two conductive circuits 614 and the two resistance circuits 615 are electrically connected to a corresponded second connecting ends 63. In the present embodiment, one conductive circuit 614, one resistance circuit 615, one first connecting end 62, and two second connecting ends 63 are grouped as a set. That is, the first connecting end 62 is electrically connected to a first conductive circuit 614 and a resistance circuit 615, and each of the conductive circuit 614 and the resistance circuit 615 is also electrically connected to a second connecting end 63. The circuit design can be adjusted according to the demand of the user and thus the present invention should not be restricted by the case of the present embodiment.

The manipulating device 7 includes a brush base 71, two brushes 72, 73, and a bar 74. The brush base 71 has a front surface 711 facing the rear surface 612 of the circuit board, and the brush base 71 constrained by the brush base guiding grooves 22, 32 is slidably positioned between the two side guiding tracks 2, 3 as the side guiding tracks 2, 3 are positioned in the allocation space 13. The brushes 72, 73 are fixed on the front surface 711 of the brush base and positioned at the two symmetric corners. Each of the brushes 72, 73 elastically presses against a set of conductive circuit 614 and resistance circuit 615 to have the conductive circuit 614 electrically connected to the resistance circuit 615 through the brush 72. The bar 74 is fixed to the brush base 71 and extended outward through the circuit board position restriction hole 613 and the shell position restriction hole 11.

The base 8 presses against the two side guiding tracks 2, 3 and has a plurality of positioning holes 81, a plurality of through holes 82, and a bottom surface 83. There are ten positioning holes 81 being used in the present embodiment (only one of them is labeled). These positioning holes 81 are corresponding to the extending fixing parts 12 such that the extending fixing parts penetrate the corresponding positioning holes 81 to have the shell 1 fixed to the base 8. Among the extending fixing parts 12, six of them are designed to be bended after penetrating the positioning holes 81 so as to engage with the bottom surface 83 of the base 8. In addition, the assembly of the base 8 and the shell 1 also has the two side guiding tracks 2, 3 and the two end locking parts 4, 5 fixed in the allocation space 13. Moreover, in the present embodiment, there are six through holes 82 on the base 8 (only one of them is labeled) corresponding to the first connecting ends 62 and the second connecting ends 63 which penetrate the corresponding through holes 82. The end locking parts 4, 5 are connected to the base 8 integrally in the present embodiment. However, the present invention is not so restricted. In accordance with the other embodiments, the end locking parts 4, 5 are separate components locked on the base 8, or constrained in the allocation space 13 together with the side guiding tracks 2, 3 and fixed by the pressing of the base 8. In addition, in the present embodiment, there are six through holes 82 corresponding to the first connecting ends 62 and the second connecting ends 63, and the first connecting ends 62 and the second connecting ends 63 penetrate and extend outward from the corresponding through holes 82.

Figure 6:
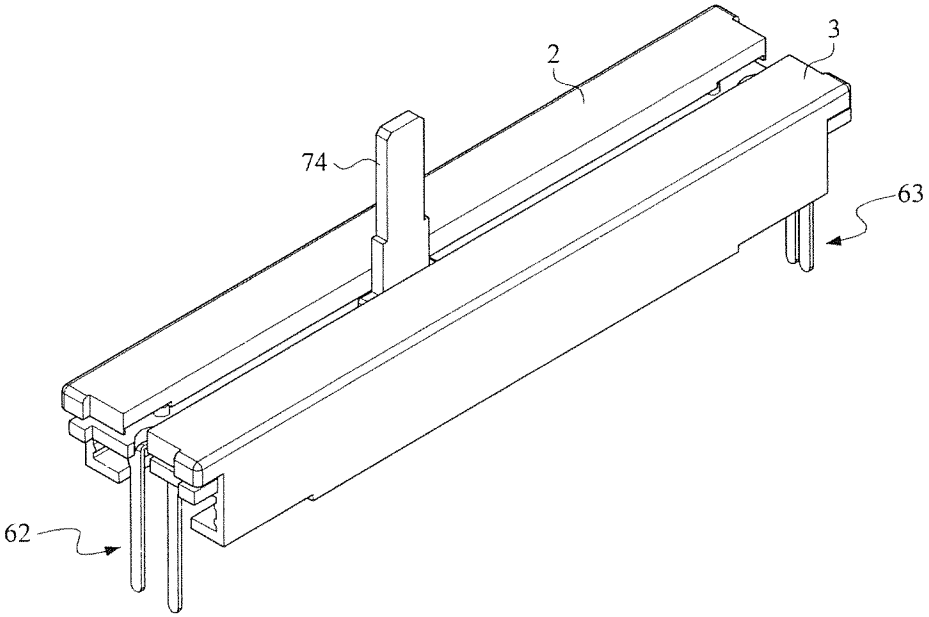
FIG. 6 is a 3D schematic view of the circuit board and the manipulating device of the variable resistor in accordance with a preferred embodiment of the present invention.
Figure 7:
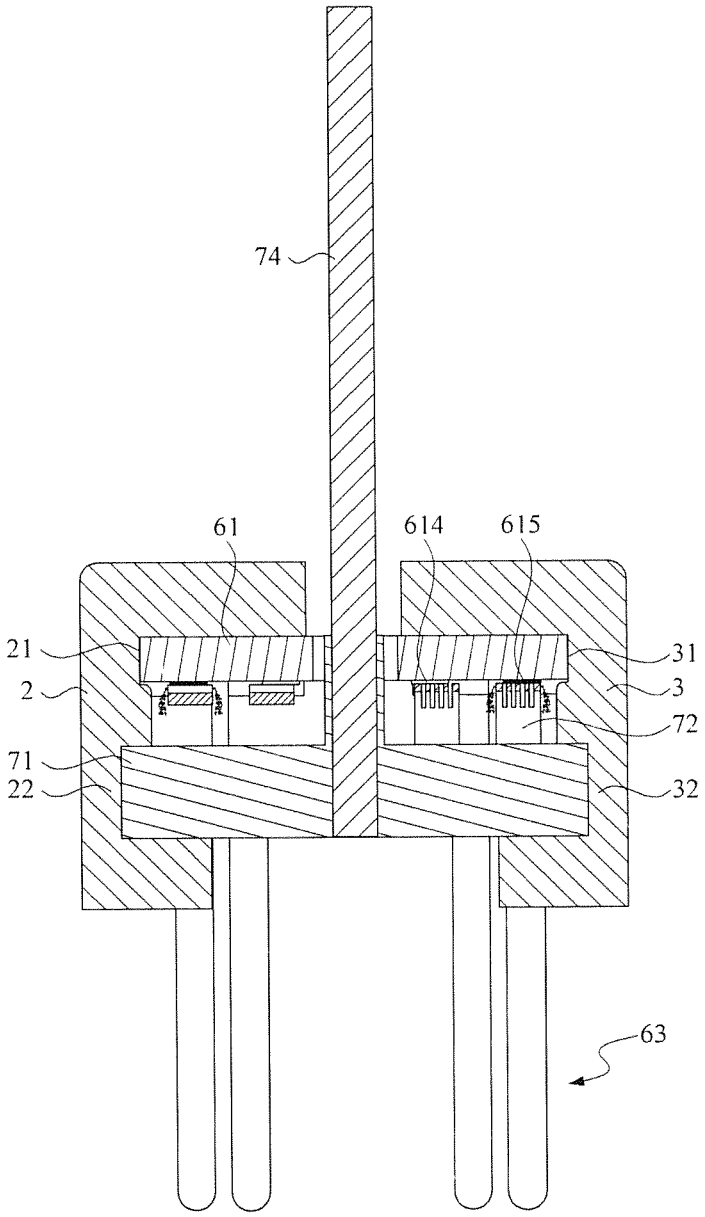
FIG. 7 is a cross-section view of the circuit board and the manipulating device of the variable resistor in accordance with a preferred embodiment of the present invention.

Please also refer to FIG. 6 and FIG. 7, wherein FIG. 6 is a 3D schematic view of the circuit board and the manipulating device of the variable resistor in accordance with a preferred embodiment of the present invention, and FIG. 7 is a cross-section view of the circuit board and the manipulating device of the variable resistor in accordance with a preferred embodiment of the present invention. As shown, because the conductive circuits 614 and the resistance circuits 615 are positioned on the rear surface 612 of the circuit board and the brushes 72, 73 are positioned on the front surface 711 of the brush base, with the feature of the circuit board position restriction hole 613 on the circuit board 61, the bar 74 can extend above the circuit board 61 and the brushes 72, 73 can press against the conductive circuits 614 and the resistance circuit 615. As the user controls the movement of the brush base 71 in the allocation space 13 along the side guiding tracks 2, 3 by using the bar 74, the particles generated by the rubbing movements of the brushes 72, 73 pressing against the conductive circuits 614 and the resistance circuits 615 will fall below the circuit board 61 rather than be accumulated on the circuit board 61 and thus the problem of short circuit between the conductive circuits 614 and the resistances 615 due to the accumulated particles can be prevented. It should be noted that in FIG. 7, the portion between the brush base 71 and the side guiding tracks 2, 3 is simplified for the purpose of better describing the feature of the present invention.

In addition, the conductive circuits 614 and the resistance circuits 615 would not be affected by the foreign matters, such as food debris, and the liquid accidently entering the allocation space 13 through the shell position restriction hole 1 and falling on the front surface 611 of the circuit board because the conductive circuits 614 and the resistance circuits 615 are positioned on the rear surface 612 of the circuit board. Moreover, after the variable resistor 100 being used for a whole, the normal operation of the conductive circuits 614 and the resistance circuits 615 would not be affected by the environmental particles entering the allocation space 13 of the variable resistor 100 through the shell position restriction hole 11 because these particles may be only accumulated on the front surface 611 of the circuit board.

In conclusion, the conventional variable resistor has the resistance circuit positioned on the front surface of the circuit board such that the particles generated as the brush rubs the resistance circuit would be accumulated on the circuit board to cause short circuit between the resistance circuit and the conductive circuit. In contrast, the variable resistor of the present invention has the features of the position restriction hole on the circuit board, the resistance circuit positioned on the rear surface of the circuit board, and the brush on the front surface of the brush base to contact the resistance circuit on the rear surface of the circuit board, such that the particles generated as the brush rubs the resistance circuit will fall down directly rather than be accumulated on the circuit board to cause short circuit between the conductive circuit and the resistance circuit. In addition, because the conductive circuits and the resistance circuits are located on the rear surface of the circuit board, circuit operation of the variable resistor would not be affected as the foreign matters and the liquid entering the allocation space through the shell position restriction hole. Similarly, circuit operation of the variable resistor would not be affected by the environmental particles because these particles are only accumulated on the front surface of the circuit board.

The detail description of the aforementioned preferred embodiments is for clarifying the feature and the spirit of the present invention. The present invention should not be limited by any of the exemplary embodiments described herein, but should be defined only in accordance with the following claims and their equivalents. Specifically, those skilled in the art should appreciate that they can readily use the disclosed conception and specific embodiments as a basis for designing or modifying other structures for carrying out the same purposes of the present invention without departing from the scope of the invention as defined by the appended claims.

We claim:

1. A variable resistor, comprising:

a shell, having a shell position restriction hole extending along an operation direction and an allocation space linked to the shell position restriction hole formed therein;

two side guiding tracks, extending along the operation direction and symmetrically assembled in the allocation space;

two end locking parts, symmetrically assembled in the allocation space and pressing against the two side guiding tracks respectively to have the two side guiding tracks and the two end locking parts constrained in the allocation space;

an inverted circuit module, comprising:

a circuit board, positioned between the two side guiding tracks, having a circuit board position restriction hole extending along the operation direction, and having a resistance circuit on a rear surface thereof; and a plurality of connecting ends, located on the circuit board;

a manipulating device, comprising:

a brush base, slidably positioned between the two side guiding tracks;

at least a brush, fixed on a front surface of the brush base and elastically pressing against the resistance circuit; and a bar, connected to the brush base and extended outward from the circuit board position restriction hole and the shell position restriction hole; and a base, pressing against the two side guiding tracks and having a plurality of through holes corresponding to the connecting ends, the connecting ends extending outward from the through holes respectively, and the shell assembled to the base to have the two side guiding tracks and the two end locking parts fixed in the allocation space.

2. The variable resistor of claim 1, wherein each of the two side guiding tracks has a locking groove, and two sides of the circuit board are locked in the locking grooves of the two side guiding tracks respectively so as to have the circuit board fixed in the allocation space.

3. The variable resistor of claim 1, wherein each of the two side guiding tracks has a guiding groove, the brush base is along the operation direction movably assembled to the guiding grooves of the two side guiding tracks to have the circuit board fixed in the allocation space.

4. A variable resistor, comprising:

a shell, having a shell position restriction hole extending along an operation direction and an allocation space linked to the shell position restriction hole formed therein;

an inverted circuit module, fixed in the allocation space, and comprising:

a circuit board, having a circuit board position restriction hole extending along the operation direction, and having a resistance circuit on a rear surface thereof; and a plurality of connecting ends, located on the circuit board; and a manipulating device, along the operation direction slidably positioned in the allocation space, and comprising:

a brush base;

at least a brush, fixed on a front surface of the brush base and elastically pressing against the resistance circuit; and a bar, connected to the brush base and extended outward from the circuit board position restriction hole and the shell position restriction hole.

5. The variable resistor of claim 4, further comprising two side guiding tracks, extending along the operation direction and symmetrically assembled in the allocation space, wherein each of the two side guiding tracks comprises:

a locking groove, two sides of the circuit board being locked in the locking grooves of the two side guiding tracks respectively so as to have the circuit board fixed in the allocation space; and a guiding groove, the brush base being movably assembled to the guiding grooves of the two side guiding tracks to have the circuit board fixed in the allocation space.

6. The variable resistor of claim 5, further comprising two end locking parts, symmetrically assembled in the allocation space and pressing against the two side guiding tracks respectively to have the two side guiding tracks and the two end locking parts constrained in the allocation space.

7. The variable resistor of claim 6, further comprising a base, pressing against the two side guiding tracks, wherein the shell is assembled to the base to have the two side guiding tracks and the two end locking parts fixed in the allocation space.

8. The variable resistor of claim 7, wherein the base further has a plurality of through holes corresponding to the connecting ends and the connecting ends extend outward from the through holes respectively.

* * * * *